United States Patent [19]

Hen et al.

[11] Patent Number: 4,821,755

[45] Date of Patent: Apr. 18, 1989

[54] CONTINUOUS-FLOW TYPE DISHWASHING APPARATUS

[75] Inventors: Tamar Hen; Yochai Kimchi, both of En-Harod, Israel

[73] Assignee: Palbam, a registered partnership, En-Harod, Israel

[21] Appl. No.: 174,736

[22] Filed: Mar. 29, 1988

[30] Foreign Application Priority Data

Feb. 3, 1988 [IL] Israel ..... 85300

[51] Int. Cl.[4] ..... B08B 3/02

[52] U.S. Cl. ..... 134/72; 134/83; 134/125; 134/126; 134/131

[58] Field of Search ..... 134/71, 72, 73, 83, 134/125, 126, 131, 67, 68, 83; 198/802

[56] References Cited

U.S. PATENT DOCUMENTS

| | | | |
|---|---|---|---|
| 975,721 | 11/1910 | Russell | 198/802 |
| 1,851,534 | 3/1932 | Baker et al. | 198/802 X |
| 2,644,473 | 7/1953 | Fox et al. | 134/125 X |
| 2,649,100 | 8/1953 | Frech | 134/125 |
| 2,747,724 | 5/1956 | Kornylak | 198/802 X |
| 3,122,235 | 2/1964 | Meeker et al. | 134/83 X |
| 3,384,097 | 5/1968 | Meeker et al. | 134/68 X |
| 3,664,482 | 5/1972 | Kornylak | 198/802 |
| 4,378,874 | 4/1983 | Schwab | 198/802 |

*Primary Examiner*—Philip R. Coe

*Attorney, Agent, or Firm*—Benjamin J. Barish

[57] ABSTRACT

A continuous-flow type dishwashing apparatus, for use by large concerns for washing dishes and other utensils in a continuous manner, comprises a closed loop conveyor disposed laterally of the washing compartment, and a plurality of racks supported in a substantially horizontally manner as they are moved by the forward stretch of the conveyor through the washing compartment, and in a substantially vertical manner as they are moved by the return stretch of the conveyor back to the washing compartment.

20 Claims, 2 Drawing Sheets

CONTINUOUS-FLOW TYPE DISHWASHING APPARATUS

BACKGROUND OF THE INVENTION

The present invention relates to dishwashing apparatus, and particularly to the continuous-flow type dishwashing apparatus used in industrial or institutional establishments.

Many continuous-flow types of dishwashing machines have been developed for use by industrial, institutional, and the other like concerns for washing dishes and other utensils in a continuous manner. Such dishwashing machines usually include a washing compartment containing washing devices for washing the dishes and the other utensils passing therethrough, and a closed loop conveyor for converying the utensils through the washing compartment. In the conventional dishwashing apparatus of this type, the conveyor is made of elements permanently or semi-permanently connected in a closed loop arranged in two tiers, including an upper horizontal stretch which receives the utensils for conveying them through the washing compartment, and a lower return stretch. However, cleaning the machine of the food debris accumulating within it is very difficult because of the two-tier conveyor system, which block access to the interior of the machine. In addition, the conveyor system frequently becomes jammed, particularly by a broken dish or other utensil falling from the upper direct stretch to the lower return stretch. Still further, the conventional two-tier system also prevents convenient access to the interior of the machine for purposes of repairing or replacement of parts.

BRIEF SUMMARY OF THE INVENTION

An object of the present invention is to provide dishwashing apparatus of the foregoing type having advantages in the above respects.

According to the present invnetion, there is provided dishwashing apparatus comprising a washing compartment containing washing devices for washing the dishes and other utensils passing therethrough; a closed loop conveyor disposed laterally of the washing compartment and including a forward stretch extending adjacent one side of the washing compartment, and a return stretch extending on the side of the forward stretch opposite to that of the washing compartment; a plurality of racks for receiving the dishes and other utensils to be washed; coupling means pivotably coupling the racks to the conveyor; and supporting means supporting the racks in a substantially horizontally position as they are moved by the forward stretch of the conveyor through the washing compartment, and for supporting the racks in a substantially vertical position as they are moved by the return stretch of the conveyor back to the washing compartment.

According to further features in the preferred embodiment of the invention described below, the supporting means comprises first and second supporting surfaces extending along opposite sides of the washing compartment; in addition, the second supporting surface includes a descending, curved, end section at one end of the conveyor for causing the racks leaving the washing compartment to pivot downwardly from their substantially horizontal positions to their substantially vertical positions, and an ascending, curved, end section at the opposite end of the conveyor for causing the racks to pivot from their substantially vertical positions to their substantially horizontal positions before they enter the washing compartment.

According to still further features in the described preferred embodiment, the washing compartment includes washing devices above and below the racks, the washing devices above the racks being spaced sufficiently above the racks to permit the racks to be pivoted upwardly for purposes of cleaning or repairing the washing compartment. Further, the couplings between the racks and the conveyor also permits the racks to be conveniently detached from the conveyor.

It will thus be seen that dishwashing apparatus constructed in accordance with the foregoing features provides a number of important advantages over the existing dishwashing apparatus of this type. Thus, there is much less possibility of jamming the conveyor system since any utensils or food debris falling through the forward stretch of the conveyor loop does not drop onto the return stretch, but rather merely drops into the dishwashing compartment where it can be conveniently removed. In addition, the interior of the washing compartment can be conveniently cleaned by merely pivoting the racks upwardly, thereby exposing the washing devices both below and above the forward stretch of the conveyor. Such an arrangement also provides very convenient access to the interior of the apparatus for purposes of repairing or replacing parts. Still further, since in this arrangement the racks are moved to a substantially vertical position during the return stretch of the conveyor, the overall size of the apparatus may be substantially reduced.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
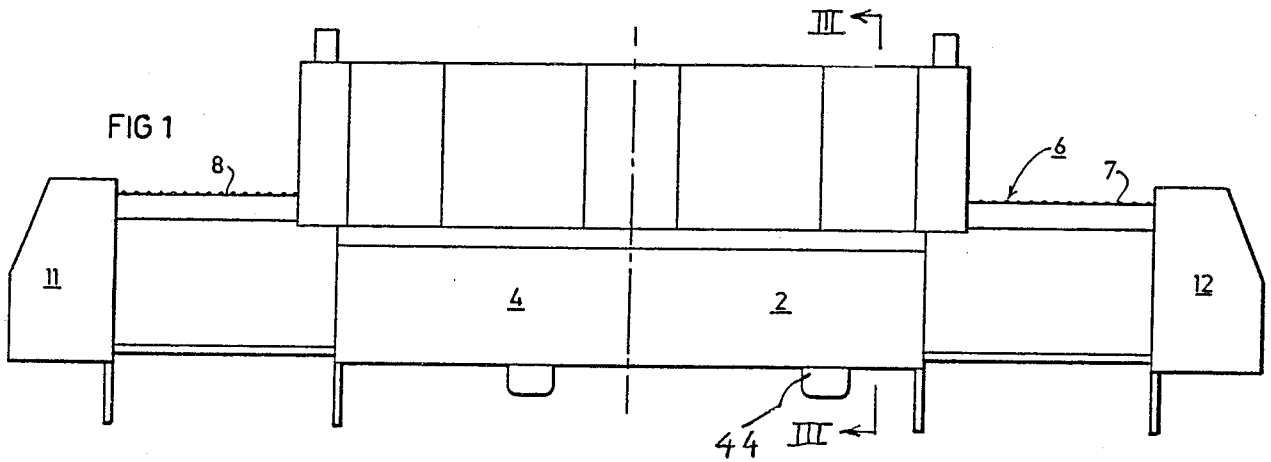
FIG. 1 is a side elevational view illustrating one form of dishwashing apparatus constructed in accordance with the present invention.

The dishwashing apparatus illustrated in the drawings is particularly useful as an industrial or institutional washing machine requiring large volumes of dishes or other utensils to be washed in a continuous manner. The illustrated apparatus comprises a washing compartment, generally designated 2, containing the washing devices for washing the utensils passing therethrough, and a rinsing and sterilizing compartment, generally designated 4, for rinsing and sterilizing the utensils after they have been washed in the washing compartment. The utensils are conveyed through compartment 2 and 4 by a closed loop conveyor, generally designated 6.

Figure 2:
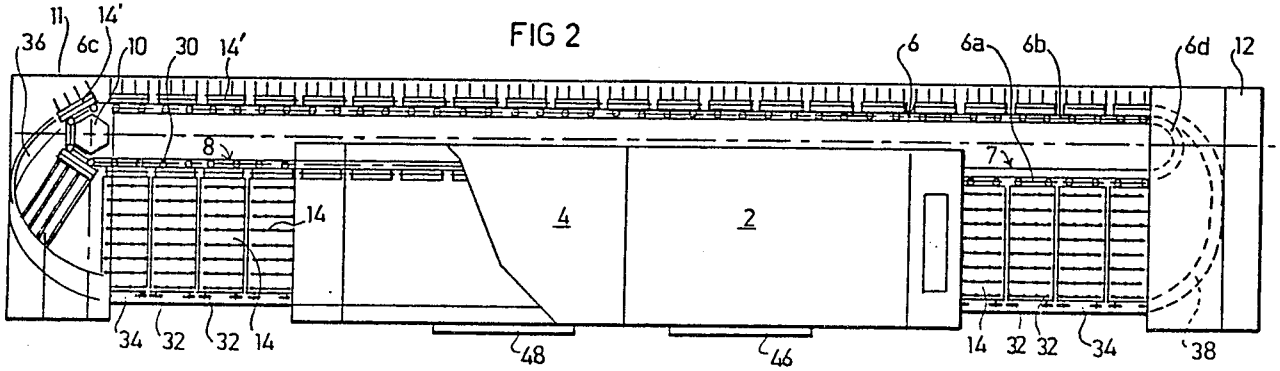
FIG. 2 is a top plan view of the apparatus of FIG. 1, partly broken-away to show internal structure.

The closed-loop conveyor 6 is a horizontal conveyor disposed laterally of the washing compartment 2 and the rinsing and sterilizing compartment 4, as shown particularly in the plan view of FIG. 2. Conveyor 6 includes a forward stretch 6*a* starting from the loading station 7 and extending through the compartments 2 and 4 to the unloading station 8, and a return stretch 6*b* extending from the unloading station 8 back to the loading station 7. The forward stretch 6*a* is disposed adjacent to one side of compartments 2 and 4, while the return stretch is disposed on the side of the forward stretch 6*a* opposite to that of compartments 2 and 4, i.e., more remote from these compartments than the forward stretch 6*a*.

Conveyor loop 6 further includes an end section 6*c* engageable by a motor-driven sprocket wheel 10 for driving the conveyor loop (clockwise) in the view of FIG. 2), and a similar end section (6*d*) at the opposite end (right end) of the conveyor loop and similarly engageable by a motor-driven sprocket wheel (not shown). The two end sections of the conveyor loop 6 are enclosed within end housing sections 11 and 12 (FIGS. 1 and 2).

Figure 4:
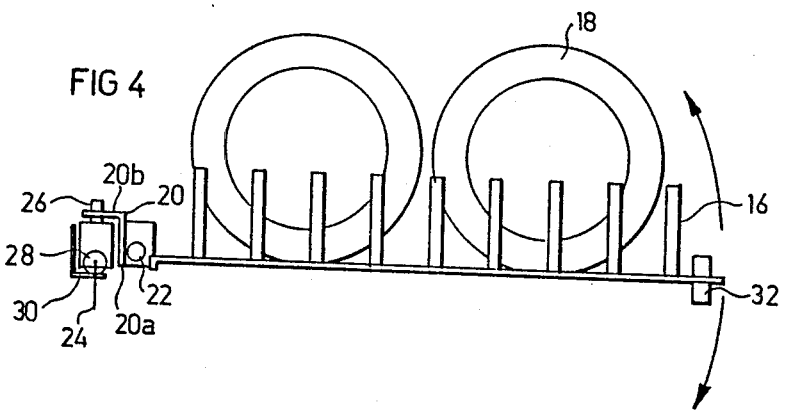
FIG. 4 is an enlarged view illustrating the structure of one of the racks in the apparatus of FIGS. 1–3, and the manner of coupling it to the closed loop conveyor.

The illustrated dishwashing apparatus further includes a plurality of racks 14 for receiving the dishes and other utensils to be washed, and coupling means pivotably coupling the racks to the conveyor 6. FIG. 4 more particularly illustrates the structure of one of the racks 14 and the manner of coupling it to the conveyor 6.

Thus, as shown in FIG. 4, each rack 14, which may be of an open wire-frame construction, includes a plurality of upstanding posts 16 arranged in spaced rows and columns for loosely supporting the dishes 18 and other utensils in a substantially vertical or partly inclined manner. One end of each rack 14 is provided with a bracket 20 pivotably mounted to the rack by a pivot pin 22. Each bracket 20 is of L-shape, including a first leg 20*a* fixed to its pivot pin 22, and a second leg 20*b*, perpendicular thereto for pivotably coupling the rack to the conveyor 6.

Conveyor 6 is a closed loop chain formed with a plurality of chain links, one of which is shown at 24 in FIG. 4. Each of the chain links, or selected ones at equally-spaced intervals, include an upstanding pin 26, and preferably also include a small depending castor 28. The upstanding pins 26 are adapted to be received within openings formed in the bracket leg 20*b* of each rack 14 to permit the quick application and removal of the rack; and castor 28, if included, is rollable along the upper surface 30 of the apparatus for supporting the forward stretch 6*a* of the conveyor.

Each rack 14 further includes a castor 32 at each of its opposite sides (FIG. 2), for rollably supporting the rack on a second supporting surface 34 of the apparatus.

It will thus be seen that surface 30 underlying the chain links 24 of the conveyor 6, and engageable by castors 28 of the chain links, serves as a first supporting surface extending along one side of compartment 2, 4; and that surface 34 (FIG. 2) engageable by castors 32 of the racks 14 serves as a second supporting surface extending along the opposite side of the compartments. Supporting surfaces 30 and 34 thus support the racks 14 in a substantially horizontal position as they are driven through the washing compartment 2 and the rinsing and sterilizing compartment 4 by the forward stretch 6*a* of the conveyor 6. The dishes and other utensils within the racks 14 are thereeby directly exposed to the washing, rinsing and sterilizing devices within these compartments.

After the dishes and the utensils have been washed, rinsed and sterilized, they are manually removed from the racks 14 at the unloading station 8. At that end of the apparatus, horizontal supporting surface 34, which is engageable by castors 32 of the racks for supporting the racks in a substantially horizontal position during their travel through the washing, rinsing and sterilizing compartments 2 and 4, then merges with a descending, curved, end section 36 such as to cause the racks 14 leaving these compartments to pivot downwardly from their substantially horizontal positions to substantially vertical positions as they enter the return stretch 6*b* of the conveyor 6, as shown by racks 14' in FIG. 2. The racks thus assume a substantially vertical position as they travel through the return stretch 6*b* of the conveyor.

At the opposite end of the return stretch (right end in FIG. 2), another curved end section of the supporting surface is provided, as shown at 38, which ascends in order to pivot the racks from their substantially vertical position when moving through the return stretch of the conveyor, to their substantially horizontal positions before they enter loading station 7 for receiving another load of utensils to be washed, rinsed and sterilized.

Figure 3:
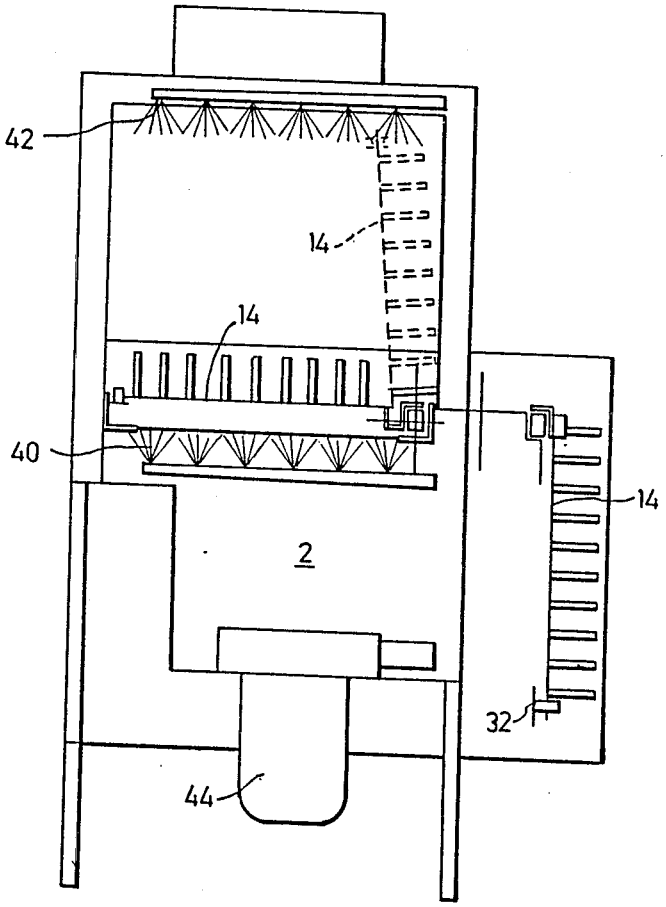
FIG. 3 is an enlarged sectional view along lines III—III of FIG. 1.

The washing devices within compartment 2, and the rinsing and sterilizing devices within compartment 4, may be conventional devices used for this purpose. FIG. 3 illustrates the interior of the washing compartment 2; it includes a lower line of nozzles 40 underlying the racks 14 as they pass through that compartment, and an upper line of nozzles 42 overlying the racks as they pass through that compartment. As shown particularly in FIG. 3, the upper line of nozzles 42 are spaced sufficiently above the racks 14 to permit the racks to be pivoted upwardly for purposes of cleaning, repairing or replacement of parts in the washing chamber. The washing liquid is discharged from nozzles 40 and 42 at relatively high velocities by pump 44 in order to thoroughly clean the dishes and other utensils carried on the racks 14 as they pass through the washing chamber.

The rinsing and sterilizing chamber 4 is similarly provided with rinsing and sterilizing devices, which may be of a conventional construction, disposed on the opposite sides of the racks 14 as they pass through that chamber, with the upper devices also being spaced sufficiently above the racks to permit the racks to be pivoted upwardly for purposes of cleaning, repairing or replacement of parts. In addition, both chambers 2 and 4 are provided with removable doors 46, 48 at their lower ends, also for cleaning, repairing or part-replacement purposes.

The operation of the illustrated dishwashing apparatus will be apparent from the above description. Thus, in the illustrated example, the conveyor 6 is driven clockwise with respect to the plan view illustrated in FIG. 2. The racks 14 are pivotably coupled to the conveyor and assume a substantially horizontal position as they are driven through the conveyor forward stretch 6*a*. That is, the racks are supported horizontally by horizontal surface 30 (FIG. 4) engageable by castors 28 of the conveyor links 24 at one side of the compartment, and by horizontal surfaces 34 (FIG. 2) engageable by castors 32 of the racks at the opposite side of the compartment.

The racks 14 are manually loaded with the dirty dishes and other utensils at the loading station 7 at the right side of the washing compartment 2. As the racks are driven through the forward stretch 6*a* of the conveyor, they pass first through the washing compartment 2, and then through the rinsing end sterilizing compartment 4. In the washing compartment 2, the dishes and other utensils carried by the racks are subjected to the high-velocity jets of washing liquid discharged by the lower nozzles 40 (FIG. 3) and the upper nozzles 42, which wash the food particles to the bottom of the washing compartment 2. The racks, including their utensils, are then driven through the rinsing and sterilizing compartment 4 where the utensils are rinsed and sterilized, so that the utensils on the racks exiting from the outlet end (left end, FIG. 2) of the compartments 2 and 4 are clean, dry and sterile. The utensils are then manually removed from the racks as they emerge from the left end of compartment 4 to the unloading station 8.

The racks then continue through the end section 10 of the apparatus, wherein the descending, curved end section 36 of supporting surface 34 causes the racks to pivot downwardly from their substantially horizontal positions to a substantially vertical position, as shown by racks 14' in FIG. 2, as the racks enter the return stretch **6*b* of the conveyor. The racks travel through the return stretch 6*b* while in the vertical position until they reach end section 12, whereat the ascending, curved, end section 38 of supporting surface 34 pivots the racks from their vertical positions to substantially horizontal positions before they enter the loading station at the right end of the washing compartment 2**.

It will thus be seen that since the return stretch **6*b* of the conveyor 6 does not underlie the forward stretch 6*a*, but rather is laterally of the forward stretch, food particles or utensils cannot drop onto the return stretch where they may jam the conveyor; rather, they will fall merely to the bottom of the respective compartments 2, 4, for easy removal via their doors 46, 48. In addition, since the racks 14 are pivotable upwardly as shown in FIG. 3, and are quickly removable by merely lifting their brackets 20 out of the pins 26 on the chain links 24, very convenient access is provided to the interior of the compartments 2, 4, as well as to the washing, rinsing and sterilizing devices therein, thereby simplifying cleaning, repairing or replacement of parts. Still further, since the racks 14 are in a substantially vertical position during the return stretch 6*b* of the conveyor 6**, the overall width of the apparatus is substantially reduced.

While the invention has been described with respect to one preferred embodiment, it will be appreciated that many other variations, modifications and applications of the invention may be made.

What is claimed is:

1. Dishwashing apparatus, comprising: a washing compartment containing washing devices for washing the dishes and other utensils passing therethrough; a closed loop conveyor disposed laterally of the washing compartment and including a forward stretch extending adjacent one side of the washing compartment, and a return stretch extending on the side of said forward stretch opposite to that of the washing compartment; a plurality of racks for receiving the dishes and other utensils to be washed; coupling means pivotably coupling the racks to said conveyor; and supporting means supporting the racks in a substantially horizontally position as they are moved by said forward stretch of the conveyor through the washing compartment, and for supporting the racks in a substantially vertical position as they are moved by said return stretch of the conveyor back to the washing compartment.

2. The dishwashing apparatus according to claim 1, wherein said supporting means comprises a first supporting surface extending along one side of the washing compartment, and a second supporting surface extending along the opposite side of said washing compartment.

3. The dishwashing apparatus according to claim 2, wherein said second supporting surface includes a descending, curved, end section at one end of the conveyor for causing the racks leaving the washing compartment to pivot downwardly from their substantially horizontal positions to their substantially vertical positions, and an ascending, curved end section at the opposite end of the conveyor for causing the racks to pivot from their substantially vertical positions to their substantially horizontal positions before they enter the washing compartment.

4. The dishwashing apparatus according to claim 3, wherein the end of each of said racks opposite to the end coupled to the conveyor carries a castor.

5. The dishwashing apparatus according to claim 1, wherein the couplings between the racks and said conveyor also permit the racks to be quickly detached from the conveyor.

6. The dishwashing apparatus according to claim 1, wherein said washing compartment includes washing devices above and below said racks, the washing devices above the racks being spaced sufficiently above the racks to permit the racks to be pivoted upwardly for purposes of cleaning or repairing the washing compartment.

7. The dishwashing apparatus according to claim 6, wherein said washing devices are sprayproducing nozzles.

8. The dishwashing apparatus according to claim 1, further including a drying compartment and a sterilizing compartment in series with said washing compartment through which the racks are conveyed while in a substantially horizontal position.

9. The washing apparatus according to claim 1, wherein said closed loop conveyor is formed with a plurality of chain links, each of said racks being coupled to one of said chain links.

10. The dishwashing apparatus according to claim 9, wherein each rack is coupled to one of said chain links by a bracket pivotably mounted to its respective rack and formed with an opening adapted to be received within a pin fixed to the respective chain link.

11. The dishwashing apparatus according to claim 10, wherein said pin is fixed in a vertical position to its respective chain link such that the respective rack may be quickly removed from the chain link by merely lifting its bracket out of the pin of the chain link.

12. The dishwashing apparatus according to claim 11, wherein said chain links further include a caster for rollably supporting the respective end of the rack.

13. Dishwashing apparatus, comprising: a washing compartment containing washing devices for washing the dishes and other utensils passing therethrough; a closed loop conveyor disposed laterally of said washing compartment and including a forward stretch extending adjacent one side of the washing compartment, and a return stretch remote from the washing compartment; a supporting surface extending along the opposite side of the washing compartment; and a plurality of racks for receiving the dishes and other utensils to be washed; one side of said racks being pivotably coupled to said conveyor; the opposite side of said racks being rollable along said supporting surface so as to support the racks in a substantially horizontal position as they pass through said washing compartment; said supporting surface including an ascending, curved, end section at one end of the conveyor for causing the racks leaving the washing compartment at the end of said forward stretch to pivot downwardly to a substantially vertical position as they are returned by said return stretch, and an ascending, curved, end section at the opposite end of the conveyor for causing the racks to pivot upwardly to a substantially horizontal position just before re-entering the washing compartment.

14. The dishwashing apparatus according to claim 13, wherein the end of each of said racks opposite to the end coupled to the conveyor carries a castor.

15. The dishwashing apparatus according to claim 13, wherein the couplings between the racks and said conveyor also permit the racks to be quickly detached from the conveyor.

16. The dishwashing apparatus according to claim 13, wherein said washing compartment includes washing devices above and below said racks, the washing devices above the racks being spaced sufficiently above the racks to permit the racks to be pivoted upwardly for purposes of cleaning or repairing the washing compartment.

17. The dishwashing apparatus according to claim 16, wherein said washing devices are spray-producing nozzles.

18. The dishwashing apparatus according to claim 13, further including a drying compartment and a sterilizing compartment in series with said washing compartment through which the racks are conveyed while in a substantially horizontal position.

19. The washing apparatus according to claim 13, wherein said closed loop conveyor is formed with a plurality of chain links, each of said racks being coupled to one of said chain links.

20. The dishwashing apparatus according to claim 19, wherein each rack is coupled to one of said chain links by a bracket pivotably mounted to its respective rack and formed with an opening adapted to be received within a pin fixed to the respective chain link in a vertical position such that the respective rack may be quickly removed from the chain link by merely lifting its bracket out of the pin of the chain link.

* * * * *